US008077189B2

(12) United States Patent
Ishida

(10) Patent No.: US 8,077,189 B2
(45) Date of Patent: Dec. 13, 2011

(54) DRIVE CIRCUIT

(75) Inventor: Tatsuya Ishida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1002 days.

(21) Appl. No.: 11/474,304

(22) Filed: Jun. 22, 2006

(65) Prior Publication Data

US 2006/0290718 A1 Dec. 28, 2006

(30) Foreign Application Priority Data

Jun. 24, 2005 (JP) ..... 2005-185470

(51) Int. Cl.
*G09G 5/10* (2006.01)

(52) U.S. Cl. ..... 345/691

(58) Field of Classification Search ..... 345/691–699, 345/208–215
See application file for complete search history.

(56) References Cited

U.S. PATENT DOCUMENTS

| | | | |
|---|---|---|---|
| 7,079,123 | B2 | 7/2006 | Shino et al. |
| 7,423,661 | B2 | 9/2008 | Abe et al. |
| 7,463,254 | B2 | 12/2008 | Shino et al. |
| 2002/0060525 | A1 | 5/2002 | Sagano et al. |
| 2002/0195966 | A1 | 12/2002 | Aoki et al. |
| 2003/0063108 | A1 | 4/2003 | Isono et al. |
| 2004/0001039 | A1 | 1/2004 | Shino et al. |
| 2004/0150660 | A1 | 8/2004 | Abe et al. |
| 2005/0116912 | A1 * | 6/2005 | Kim ..... 345/89 |
| 2006/0050361 | A1 | 3/2006 | Johnson |
| 2006/0227078 | A1 | 10/2006 | Shino et al. |

FOREIGN PATENT DOCUMENTS

| | | | |
|---|---|---|---|
| JP | 11-015430 | | 1/1999 |
| JP | 2000-235370 | A | 8/2000 |
| JP | 2002-156938 | A | 5/2002 |
| JP | 2002-311885 | A | 10/2002 |
| JP | 2003-108058 | A | 4/2003 |
| JP | 2003-114638 | A | 4/2003 |
| JP | 2003-195800 | A | 7/2003 |
| JP | 2004-086130 | A | 3/2004 |
| JP | 2004-219430 | A | 8/2004 |
| JP | 2004-347629 | A | 12/2004 |
| JP | 2005-141260 | A | 6/2005 |
| TW | 200421246 | | 10/2004 |
| WO | WO-2004/036537 | A1 | 4/2004 |

* cited by examiner

*Primary Examiner* — Tammy Pham
(74) *Attorney, Agent, or Firm* — Edwards Wildman Palmer LLP; David G. Conlin; William J. Daley, Jr.

(57) ABSTRACT

A drive circuit of the present invention is a drive circuit for driving a display element in accordance with grayscale information, which circuit outputs a drive waveform controlled through (i) plural-stepped voltage amplitude modulation and (ii) a pulse width modulation which is settable for each voltage amplitude of the plural-stepped voltage amplitude modulation, the drive circuit including an output control section for (A) latching a pulse width corresponding to a maximum voltage amplitude, according to the grayscale information, which amplitude is one of plural steps of amplitudes of the drive waveform, and which amplitude is to be outputted, so as to control a pulse width of the maximum voltage amplitude, and (B) outputting a maximum pulse width for a voltage amplitude smaller than the maximum voltage amplitude. With this drive circuit, it is possible to realize a drive circuit, whose circuit scale is smaller, for driving a display device including luminescent elements arranged in a matrix manner, the drive circuit generating a drive signal having been controlled by a voltage amplitude modulation (AM) and a pulse width modulation (PWM).

11 Claims, 11 Drawing Sheets

| | | | |
|---|---|---|---|
| V1START | 1 | V1END | 259 |
| V2START | 2 | V2END | 258 |
| V3START | 3 | V3END | 257 |
| V4START | 4 | V4END | 255 |

| MAXIMUM AMPLITUDE | VOLTAGE VALUE DATA LATCH | | DECODE OUTPUT | | |
|---|---|---|---|---|---|
| | UPPER BIT | LOWER BIT | CTL1 | CTL2 | CTL3 |
| V1 | 0 | 0 | 0 | 0 | 0 |
| V2 | 0 | 1 | 1 | 0 | 0 |
| V3 | 1 | 0 | 1 | 1 | 0 |
| V4 | 1 | 1 | 1 | 1 | 1 |

DRIVE CIRCUIT

This Nonprovisional application claims priority under 35 U.S.C. §119(a) on Patent Application No. 2005/185470 filed in Japan on Jun. 24, 2005, the entire contents of which are hereby incorporated by reference.

FIELD OF THE INVENTION

The present invention relates to a drive circuit for driving luminous elements which are arranged in a matrix manner. In particular, the present invention is preferably related to a drive circuit for an SED (Surface Conduction Electron Emitter Display) which performs a high-grayscale display.

BACKGROUND OF THE INVENTION

Conventionally, a voltage amplitude modulation (AM) control or a pulse width modulation (PWM) control has been performed in a drive circuit for a luminescent element (e.g. LED (Light Emitting Diode), EL (Electro Luminescence), FED (Field Emission Display), or SED) whose brightness varies in accordance with an applied voltage, for the purpose of controlling the brightness of the luminescent element.

In the AM control, a voltage value of a drive signal to be applied to the luminescent element is varied in accordance with the display-brightness intended. Further, in the PWM control, a pulse width of a drive signal having a predetermined voltage amplitude is varied in accordance with the display-brightness. In this case, a human senses the length of a luminescent period as a difference in a the brightness, as a result of integrating on a time-basis the length of the luminescent period in the human's vision.

Further, a drive method which is a combination of the AM control and the PWM control is suggested as a method which allows for a high quality grayscale displaying to realize a high expressive power (e.g. Japanese Unexamined Patent Publications No. 015430/1999 (Tokukaihei 11-173159; Published on Jan. 22, 1999; hereinafter, Patent Document 1) and No. 173159/2003 (Tokukai 2003-173159; Published on Jun. 20, 2003; hereinafter, Patent Document 2; corresponding foreign application: US2002/0195966). With the combination of the two control methods, an amplitude resolution and a pulse width resolution are kept from unnecessarily increasing with an increase in the grayscale level, and the high grayscale displaying, therefore, can be easily realized.

Incidentally, the following problems take place if adopting a combination of the PWM control and the AM control as a method for driving a luminous elements which are wired and arranged in a matrix manner. Namely, a ringing occurs due to the inductance of a signal line connected to the luminous elements, and a display quality is deteriorated due to round waveform attributed to resistance component and a capacitance between lines. The Patent document 2 discloses the following drive method, for solving these problems, which uses a drive waveform having a stair-like rising and falling shapes.

The Patent Document 2 describes an example of a drive waveform used for 1024-grayscale (10 bits) displaying performed by combining the 4-grayscale AM control with 259-grayscale PWM control. FIG. 11 illustrates examples of such a drive waveforms. For the sake of easier understanding, FIG. 11 only illustrates drive waveforms of suitably selected grayscale levels having characteristic waveforms, instead of illustrating the waveforms of all the grayscale levels.

In the AM control, an amplitude is controlled to four electric potentials which are: a first grayscale voltage amplitude V1; a second grayscale voltage amplitude V2; a third grayscale voltage amplitude V3; and a fourth grayscale voltage amplitude V4, in an order from lower to higher grayscale levels. Meanwhile, in the PWM control, a pulse width is controlled to be in a range from ΔT to ΔT×259, where ΔT is the smallest unit of the pulse width. As illustrated in FIG. 11, each drive waveform is controlled to have a stair-like shape in which rising and falling portions (i.e. a point at which the voltage amplitude varies) of the drive waveform have a potential difference corresponding to one grayscale level of the AM control. Note that potentials V1 to V4 are determined, based on the brightness of a luminescent element in relation to an applied voltage, so that the respective potential differences from a reference potential V0 corresponding to zero brightness (i.e. V1−V0, V2−V0, V3−V0, and V4−V0) are applied voltages respectively corresponding to four intended grayscale levels.

Here, for the sake of convenience, the concept of grayscale blocks illustrated in FIG. 12 is introduced. In the drive waveform illustrated in FIG. 12, each square surrounded by solid lines is one grayscale block. Here, it is supposed that the potential difference corresponding to each grayscale level of the 4-grayscale AM control is: ΔV1=V1−V0; ΔV2=V2−V1; ΔV3=V3−V2; and ΔV4=V4−V3. This may be also expressed as ΔVk=Vk−V(k−1), where: k is an integer, and is 1≦k≦4; Vk is k th grayscale voltage amplitude; and ΔVk is a potential difference. The grayscale block is a block which is defined by ΔVk×ΔT, where ΔVk is the potential difference corresponding to one grayscale level of the AM control, and ΔT is a minimum pulse width.

With the use of such a grayscale block, an arbitrary drive waveform can be expressed in the form of an outline formed by placing the grayscale blocks with no space, in a 4×259 matrix whose vertical axis is divided into 4 levels (ΔV1 to ΔV4), and whose horizontal axis is divided into 259 ΔTs. Each of the grayscale blocks is equivalent to one grayscale level of the brightness. One grayscale block is added every time the grayscale level increases by one level. As such, in the shape of a drive waveform of a subsequent grayscale level, the number of the grayscale blocks is increased by one.

A waveform having stair-like rising and falling means that every time the voltage amplitude varies in increment of the minimum pulse width ΔT, a step is formed by placing the grayscale block so that the variation in the voltage amplitude correspond to one grayscale block. Since the rising and falling of the waveform form a stair-like shape without an exception, a pulse width of at least 259 columns is needed for allotting 1024 grayscale levels (0 to 1023 blocks).

With the drive waveform formed under such rules, various drive waveforms are possible depending on how the grayscale blocks are placed. Further, Patent Document 2 teaches a preferred example of drive waveform illustrated in FIG. 13, which waveform is obtained by combining the AM control and the PWM control, and which has the stair-like shaped rising and falling. This drive waveform is also an exemplary drive waveform for performing 1024-grayscale (10 bit) displaying by combining the 4-grayscale AM control with the 259-grayscale PWM control.

Firstly, starting from the $1^{st}$ grayscale level, a grayscale block is placed, every time the grayscale level increase, in the row of the minimum voltage amplitude V1. In the row of the minimum voltage amplitude V1, a maximum of 259 blocks can be placed. As such, the grayscale blocks can be placed in the row of the voltage amplitude V1, until the grayscale level is $259^{th}$.

From the $260^{th}$ grayscale level, the grayscale block is also placed in the row of the voltage amplitude V2. This means that the AM control is also performed in combination with the PWM control, with respect to the drive waveform. Here, the $260^{th}$ block is placed in the second column, instead of the first column, so that one column (=ΔT) is left open. This forms a stair-like rising portion in the drive waveform. After the $261^{st}$ grayscale level, the grayscale block is successively placed in the row of the voltage amplitude V2, up to the $258^{th}$ column: i.e., up to the $516^{th}$ grayscale level. By placing the grayscale block in the row of the voltage amplitude V2, and leaving the $259^{th}$ column open, the drive waveform has a falling portion which is also in the stair-like shape.

From the $517^{th}$ grayscale level, the grayscale block is also placed in the row of the voltage amplitude V3. Here, the $517^{th}$ block is placed in the third column, leaving two columns (=ΔT×2) opened, so that the drive waveform has the stair-like rising portion. After the $518^{th}$ grayscale level, the grayscale block is successively placed in the row of the voltage amplitude V3, up to the $257^{th}$ column: i.e., up to the $771^{st}$ grayscale level. By placing the grayscale block in the row of the voltage amplitude V3, and leaving the $258^{th}$ and $259^{th}$ columns open, the drive waveform has a falling portion which is also in a stair-like shape.

From the $772^{nd}$ grayscale level, the grayscale block is also placed in the row of the voltage amplitude V4. Here, the $772^{nd}$ block is placed in the $4^{th}$ column, leaving three columns (=ΔT×3) opened, so that the drive waveform has a stair-like rising portion. After the $773^{rd}$ grayscale level, the grayscale block is successively placed in the row of the voltage amplitude V4, up to the $255^{th}$ column: i.e., up to the $1023^{rd}$ grayscale level.

By placing the grayscale blocks as described above, it is possible to realize a drive waveform having stair-like rising and falling portions. In this modulation method for realizing such a drive waveform, the voltage amplitude is modulated after the entire pulse width is used. This is advantageous in that the variation in the voltage amplitude within a pulse cycle is made small, and the drive current is equalized.

The Patent Document 2 discloses various examples of such a drive waveform, and further discloses the following drive circuit for efficiently generating the drive waveform. Namely, the drive circuit efficiently generates the drive waveform, by utilizing such a characteristic that a drive waveform having only one rising and one falling (as is the case of the examples shown in FIGS. 12 and 13) through out the entire waveform is easily defined by the respective positions of the left-end block 101 and right-end block 102 in each of the voltage amplitudes.

FIG. 14 is a block diagram for explaining a characteristic of the drive circuit disclosed in Patent Document 2. An output controlling circuit 801 is a circuit which generates, in response to modulation data 802 converted from a brightness signal, a pulse width signal for each of the voltage amplitude of the AM control. This output controlling circuit 801 includes: V1 to V4 start circuits 820 which respectively generate output-start timing signals for the voltage amplitudes V1 to V4; V1 to V4 end circuits 830 which respectively generate output-end timing signals; and V1 to V4 PWM circuits 814 which respectively generate pulse width signals, in response to the output-start timing signals from the start circuits, and the output-end timing signals from the end circuits. The output circuit 807 is so configured as to (i) receive the pulse width signal generated by the output controlling circuit 801, which signal corresponding to each voltage amplitude, and (ii) outputs as a drive signal 808, a period according to the pulse width signal, and a corresponding electric potential. In short, the output circuit 807 is a circuit which generates the final form of the drive waveform.

Each of the start circuits 820 and each of the end circuits 830 have a decoding circuit 821; a counter 822 and a comparator 823 to which respective output signals from the decoding circuit 821 and the counter 822 are input. This configuration is common in all of the start circuits and the end circuits. The modulation data 802 is input to the decoding circuit 821 of the start circuit 820 and the end circuit 830. The drive waveform for each grayscale level is determined in a one-waveform-to-one grayscale-manner. Thus, the decoding circuit 821 is set so as to output, based on the grayscale data in the modulation data 802, data which specifies a waveform corresponding to a grayscale level to be displayed. The counter 822 generates numerical data which is counted up or counted down in sync with a clock signal 805. Here, in the output controlling circuit 801, operations in relation to the voltage amplitudes V1 to V4 are all the same. On this account, the following explanation deals with an operation of the circuit in relation to the voltage amplitude V1 as a representative of operations in relation to the rest of the voltage amplitudes.

The decoding circuit 821 in the V1 start circuit 820 is set so as to output, in response to reception of the grayscale data in the modulation data 802, data which corresponds to a V1 output-start timing: i.e. a position of the left-end grayscale block in the ΔV1 row of the waveform illustrated in FIG. 12. Further, the decoding circuit 821 in the V1 end circuit 830 is set so as to output data which corresponds to a V1 output-end timing: i.e., a position of the right-end grayscale block in the ΔV1 row. Then, in each of the circuits, the comparator 823 compares the positional data with a value of the counter 822. If the value match with the data, each of the circuit outputs a V1 start signal or a V1 end signal which takes "1" as a logical value. The V1 PWM generating circuit 814 is configured by an RS flip-flop circuit. This V1 PWM generating circuit 814 is set by the V1 start signal, and is reset by the V1 end signal, so as to generate a pulse width signal TV1 which (i) rises to "1" at the timing of output-starting, and (ii) falls to "0" at the timing of output-ending, the pulse width signal TV1 corresponding to the voltage amplitude V1.

The output circuit 807 receives thus generated pulse width signals TV1 to TV4 respectively corresponding to the voltage amplitudes. Then, in accordance with the timings of the pulse width signals TV1 to TV4, the output circuit 807 switches over the output, amongst power sources whose respective electric potentials are V1 to V4. Thus, the output circuit 807 is able to output a drive waveform whose pulse width is regulated by the pulse width signal, and which corresponds to four steps of voltage amplitude.

However, the circuit suggested in Patent Document 2 needs to be a large scale circuit, so as to correspond to various drive waveforms. For example, in the case of the circuit which performs 1024-grayscale (10 bits) displaying by combining the 4-grayscale AM control and 259-grayscale PWM control, each output requires eight decoding circuits, eight counters and eight comparators, so as to generate a pulse width signal from the output-start timing and output-end timing for each of the output amplitudes of the 4 electric potentials. In a case of line-sequential driving, these circuits are needed for each pixel in the horizontal direction of a display device, and the circuit scale consequently becomes extremely large. This problem is particularly conspicuous in a large screen or high-quality display device having a large number of pixels.

Here, the drive waveform referred in the explanation of the BACKGROUND ART with reference to FIG. 13 has the following characteristics. Namely, in the AM control, the output-starting position of each amplitude is defined and is not varied. Further, in the AM control, an amplitude smaller than the maximum amplitude of a waveform is always outputted up to an output-ending position (maximum value) which is defined for each amplitude. Accordingly, it is only the maximum amplitude which is subjected to pulse width modulation according to the brightness and grayscale.

Since the output-starting position and the output-ending position (maximum value) of each amplitude are not varied in the AM control, a waveform of a unique drive waveform for each grayscale is regulated simply by supplying, as modulation data for each output, data which indicates pulse width of the maximum amplitude in a drive waveform to be outputted. Based on this new finding, the circuit scale is reduced by the following means.

SUMMARY OF THE INVENTION

In order to achieve the foregoing object, a drive circuit of the present invention is a drive circuit for outputting a drive waveform so as to drive a display element in accordance with grayscale information, the drive waveform being controlled by (i) a plural-stepped voltage amplitude modulation and (ii) a pulse width modulation which is settable for each voltage amplitude of the plural-stepped voltage amplitude modulation, said drive circuit comprising output control means for controlling the drive waveform, at a time of modulating arbitrary grayscale information, said output control means (A) latching a signal indicating a pulse width corresponding to a maximum voltage amplitude to be outputted so as to control a pulse width of the maximum voltage amplitude, and (B) outputting a maximum pulse width for a voltage amplitude smaller than the maximum voltage amplitude.

In this drive circuit, the drive waveform is generated based on modulation data which includes a maximum value of a voltage amplitude to be outputted, and an output-ending position of the maximum voltage amplitude. For the maximum voltage amplitude, the pulse width is controlled based on the modulation data, and the maximum pulse width is outputted for an amplitude other than the maximum voltage amplitude. Thus, a drive waveform indicating a predetermined grayscale level is formed, and a luminescent element is driven by the drive waveform.

Further, a drive circuit of the present invention is a drive circuit for outputting a drive waveform so as to drive a display element in accordance with grayscale information, the drive waveform being controlled by (i) a plural-stepped voltage amplitude modulation and (ii) a pulse width modulation which is settable for each voltage amplitude of the plural-stepped voltage amplitude modulation, said drive circuit comprising: voltage value data latching means, at a time of modulating arbitrary grayscale information, for latching first data indicating a maximum voltage amplitude to be outputted; PWM data latching means, at the time of modulating arbitrary grayscale information, for latching second data indicating a pulse width of the maximum voltage amplitude; output-range signal generating means, at the time of modulating arbitrary grayscale information, for generating and outputting an output-range signal in accordance with a maximum pulse width of each voltage amplitude; and one or more control means, at the time of modulating arbitrary grayscale information, for (a) outputting a pulse width of the maximum voltage amplitude according to the first data and the second data, and (b) outputting a maximum pulse width according to the output-range signal, when a voltage amplitude is smaller than the maximum voltage amplitude.

In this drive circuit, a voltage value data latching section (voltage value data latching means) latches maximum voltage amplitude data (first data) from the grayscale information, and the PWM data latching section (PWM data latching means) latches pulse width data (second data) of the maximum voltage amplitude. Further, with the use of output-range signal generating section (output-range signal generating means), a voltage amplitude other than the maximum voltage amplitude is outputted with a maximum pulse width. Further, control section (control means) outputs (i) a pulse width of the maximum voltage amplitude, in accordance with the maximum amplitude data and the pulse width data for the maximum voltage amplitude, and (ii) a maximum pulse width for each voltage amplitude smaller than the maximum voltage amplitude. Thus, a drive waveform indicating a predetermined grayscale level is formed, and a luminescent element is driven by the drive waveform.

In each of these drive circuits, an intended drive waveform is generated simply by generating, from the modulation data, a pulse width signal for the maximum amplitude. Thus, it is possible to reduce the circuit scale.

Additional objects, features, and strengths of the present invention will be made clear by the description below. Further, the advantages of the present invention will be evident from the following explanation in reference to the drawings.

DESCRIPTION OF THE EMBODIMENTS

Embodiment 1

Figure 1:
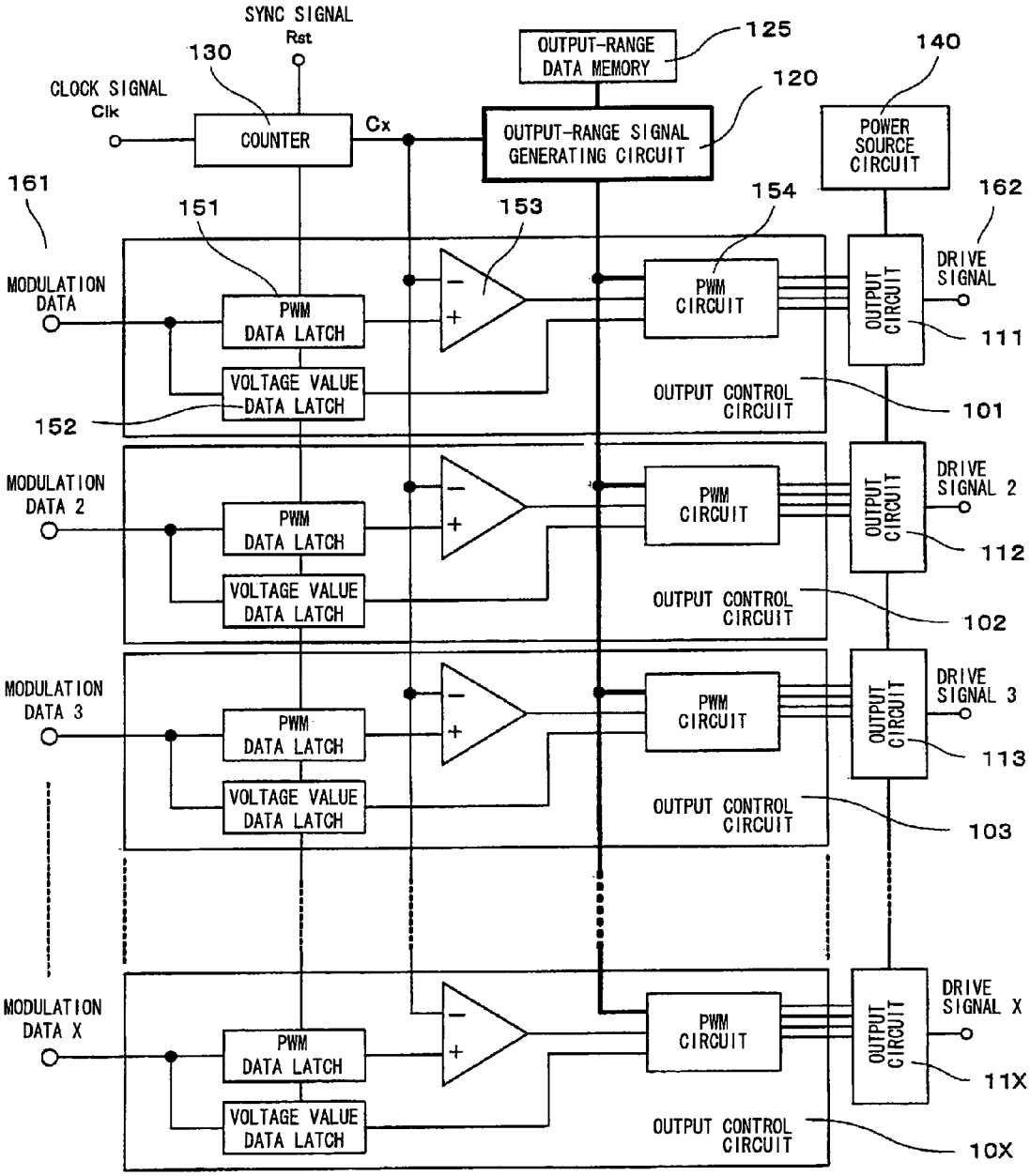
FIG. 1 is a block diagram illustrating a configuration of Embodiment 1 in accordance with the present invention.
Figure 13:
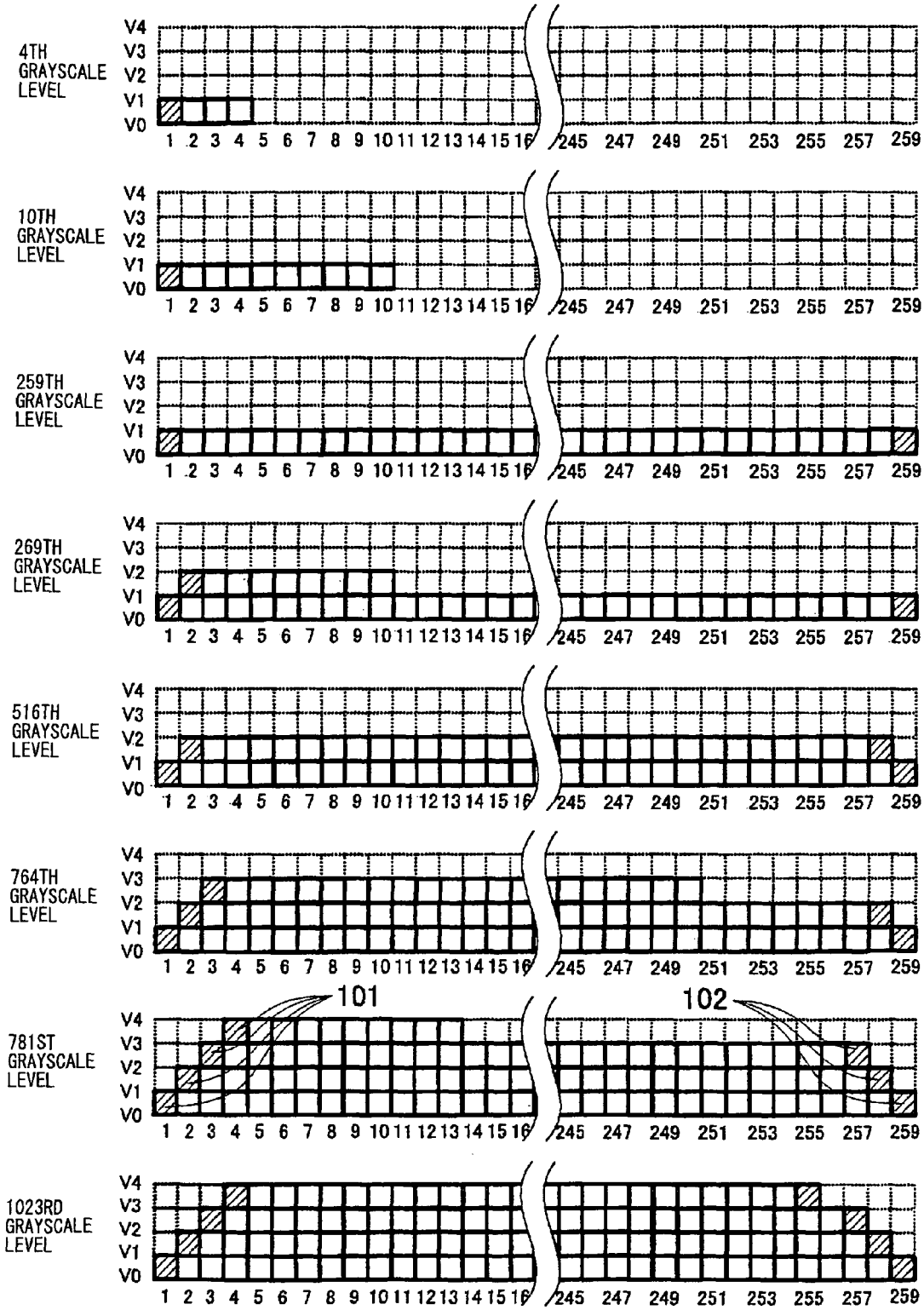
FIG. 13 is another drive waveform chart for explaining "BACKGROUND ART".
Figure 14:
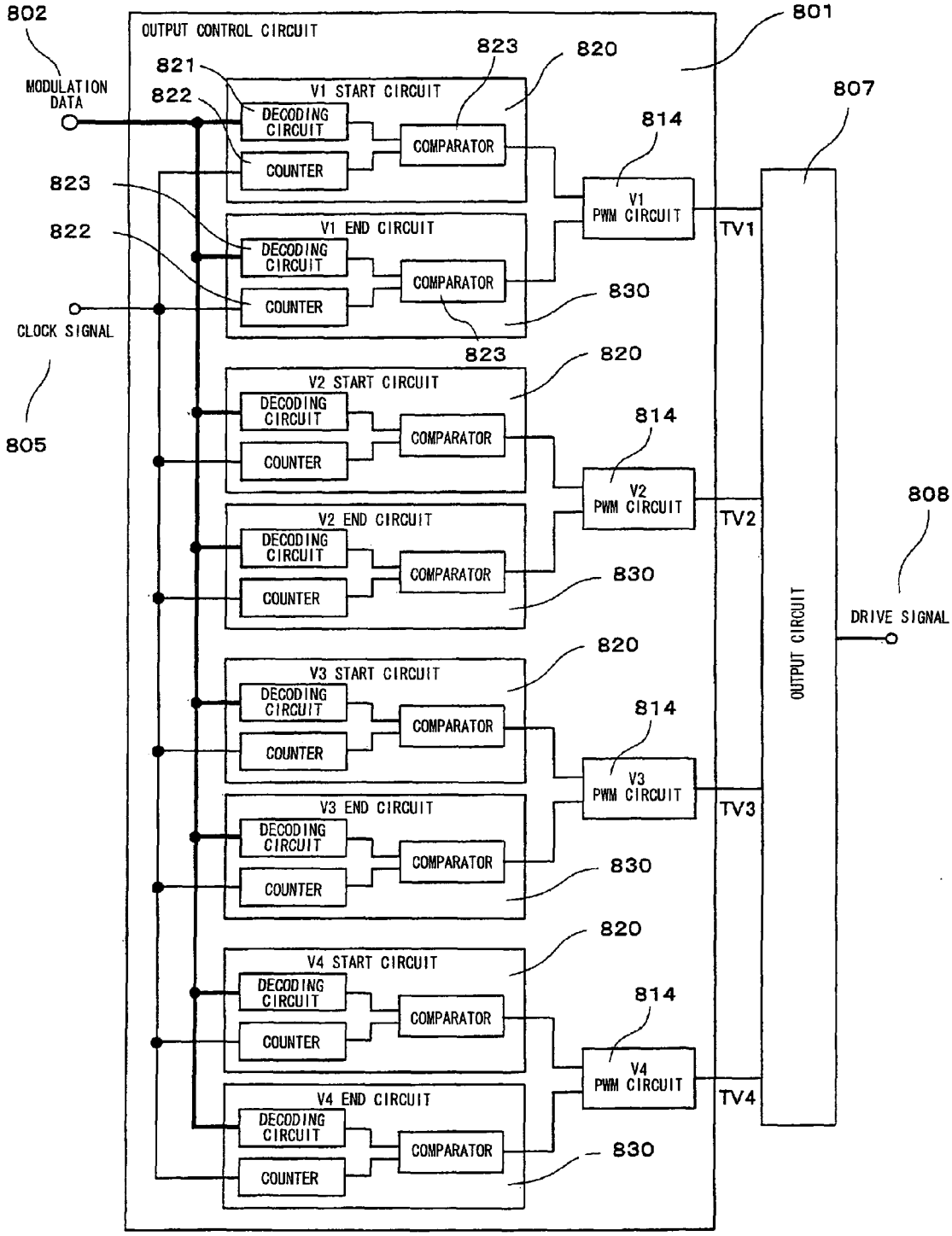
FIG. 14 is a block diagram illustrating a configuration of a drive circuit in "BACKGROUND ART".

FIG. 1 illustrates an embodiment of a drive circuit in accordance with the present invention. The present embodiment deals with a drive circuit for driving a display device having luminescent elements arranged in a matrix manner. The drive circuit controls 1024 grayscale levels for each pixel, with a use of a drive waveform of FIG. 13 obtained by performing a 4-grayscale amplitude modulation (Hereinafter, 4-grayscale AM) in combination with a 259-grayscale pulse width modulation (Hereinafter, 259-grayscale PWM).

The drive circuit includes: an output-range data memory 125; an output-range signal generating circuit (output-range signal generating means) 120; a counter 130; output controlling circuits (output control means) 101 to 10X and output circuits 111 to 11X, for simultaneously driving luminescent elements aligned in a line selected according to a scanning signal; and a power sauce circuit 140 for supplying, to the output circuits 111 to 11X, electric potentials respectively corresponding to each of AM amplitudes which are amplitudes resulted by performing the AM.

To the counter 130, a sync signal Rst and a clock signal Clk are input, and the counter 130 generates numerical data Cx which is counted up in sync with these signals. The numerical data Cx is reset to zero at the timing of the sync signal Rst which is synchronized with a scan signal, and is counted up at the cycle of the clock signal Clk. The output-range data memory 125 stores therein output-starting position data and output-ending position data corresponding to a maximum pulse width of each AM amplitude. From the data stored in the output-range data memory 125 and the data Cx from the counter 130, the output-range signal generating circuit 120 generates an output-range signal which is synchronized with the clock. Then, the output-range signal generating circuit 120 supplies the output-range signal to each of the output controlling circuits 101 to 10X. Note that the respective circuit configurations of the output controlling circuits 101 to 10X are the same, and the respective configurations of the output circuits 111 to 11X are also the same. For this reason, the output controlling circuit 101 and the output circuit 111 are described hereinbelow, as a representative of the output controlling circuits 101 to 10X and the output circuits 111 to 11X, respectively.

To the output controlling circuit 101, modulation data 161 corresponding to a grayscale level to be displayed is input. The modulation data 161 indicates (i) a value of the maximum AM amplitude in the waveform of a drive signal to be outputted, and (ii) the output-ending position of the maximum AM amplitude. In order to express the 4-grayscale (2 bits) AM and 259-grayscale (9 bits) PWM, the modulation data 161 for a single pixel is in 11 bits. In the present embodiment, the maximum amplitude value data (first data) is allotted to the upper 2 bits, and the output-ending position data (second data) of the maximum amplitude is allotted to the lower 9 bits. The upper 2 bits, of the modulation data 161, representing the maximum amplitude value are stored in a voltage value data latch (voltage value data latching means) 152, and the lower 9 bits which is the output-ending position data is stored in a PWM data latch (PWM data latching means) 151. The comparator 153 compares the data of the PWM data latch 151 with the data Cx of the counter 130, and outputs an output-end timing signal for the maximum amplitude. A PWM circuit (control means) 154 generates, for each of the AM amplitudes, a pulse width signal which is modulated to a pulse width to be outputted. Such a pulse width signal is generated from: (i) the output-range signal generated by the output-range signal generating circuit 120; (ii) the output-end timing signal outputted from the comparator 153; and the data of the voltage value data latch 152.

For each of the AM amplitude, the output circuit 111 receives the pulse width signal which is generated in the PWM circuit 154. Then, the output circuit 111 outputs a drive signal 162 having a drive waveform which has been subjected to the AM control and the PWM control. This output circuit 111 is capable of outputting, according to the timing of the pulse width signal for each AM amplitude, an electric potential corresponding to each AM amplitude, which potential is supplied from the power source circuit 140.

Next, the following deals with examples of functional parts which are illustrated as blocks in FIG. 1, for the purpose of explaining the present embodiment in further detail.

Figure 2:
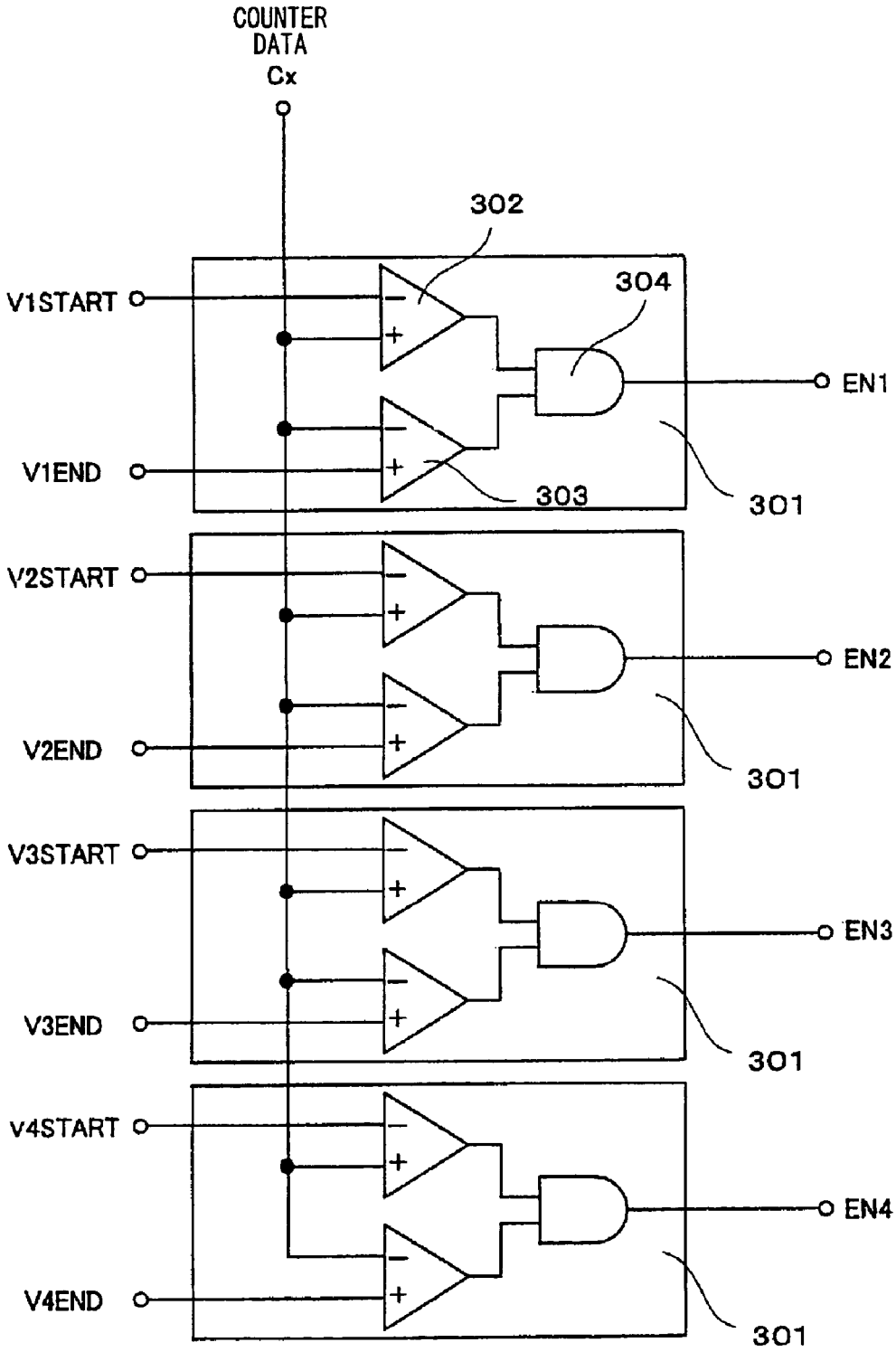
FIG. 2 is a circuit diagram illustrating an exemplary output-range signal generating circuit in FIG. 1.

FIG. 2 illustrates an example of the output-range signal generating circuit 120 of the present invention. In the output-range signal generating circuit 120, four range-signal generating sections 301 are aligned. Each of the range-signal generating sections 301 includes: two comparators 302 and 303; and an AND gate 304.

Figures 5, 6, 7:
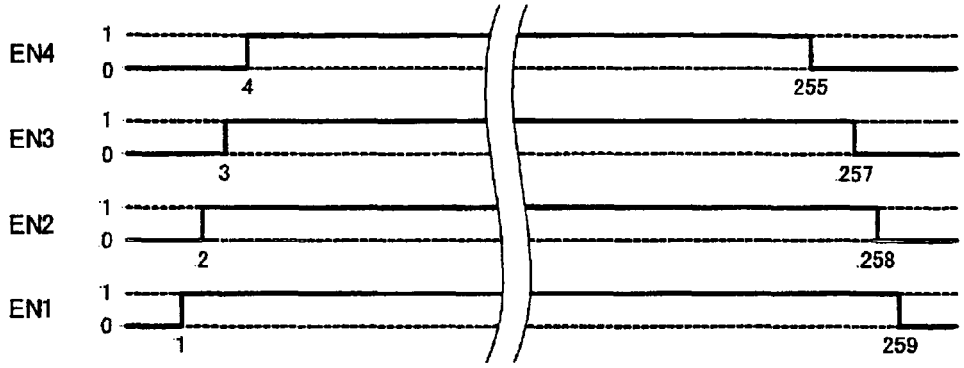
FIG. 5 is a table indicating data values for explaining an operation of the circuit illustrated in FIG. 2.
FIG. 6 is an output signal waveform chart for explaining the operation of the circuit illustrated in FIG. 2.
FIG. 7 is a truth table for explaining an operation of the circuit illustrated in FIG. 3.

V1START to V4START are the output-starting position data of the respective maximum pulse widths of the AM-amplitudes (V1 to V4). Further, V1END to V4END are the output-ending position data of the respective maximum pulse widths of the AM-amplitudes (V1 to V4). These data pieces are read out from the output-range data memory 125 described with reference to FIG. 1, and are used in calculating and generating the output-range signals EN1 to EN4. Note that, in the present embodiment, respective values of the V1START to V4START, and V1END to V4END are set as shown in FIG. 5.

The range-signal generating sections 301 have the same configuration, and operates in the same manner. Accordingly, the circuit block to which the V1START and V1END are input are described as representative hereinbelow. The counter data Cx is input to one terminal of the comparator 302, and the V1START is input to another terminal of the comparator 302. The comparator 302 compares these two pieces of data. Then, the comparator 302 outputs "1", if the counter data Cx is equal to or larger than the V1START, and outputs "0" if the counter data Cx is smaller than the V1START. Further, the counter data Cx is input to one terminal of the comparator 303, and the V1END is input to another terminal of the comparator 303. The comparator 303 compares these two pieces of data. Then, the comparator 303 outputs "1,", if the counter data Cx is equal to or smaller than the V1END, and outputs "0" if the counter data Cx is larger than the V1END. Output terminals of the comparators 302 and 303 are connected to an input terminal of the AND gate 304 from which a logical product of the outputs of the comparators 302 and 303 is outputted as the output-range signal EN1.

In this operation, the output-range signal EN1 is "1" while the counter data Cx is larger than V1START, but is smaller than the V1END. During the other periods, the output-range signal EN1 is "0". The V1START and V1END are respectively the output-starting position data and the output-ending position data of the maximum pulse width of the amplitude V1. As such, the present circuit block outputs "1" as the logical signal of the output-range signal EN1, for a period corresponding to a period in which the amplitude V1 is output.

Similarly, the logical values of the output-range signals EN2 to EN4 are "1" for periods corresponding to periods in which the amplitudes V2 to V4 are output, respectively. FIG. 6 illustrates exemplary signal waveforms of the output-range signals EN1 to EN4. As described with reference to FIG. 1, the output-range signal generated through such a method is supplied to the PWM circuits of the output controlling circuit 101 to 10X for each of the simultaneously driven pixels in the same row.

Figure 3:
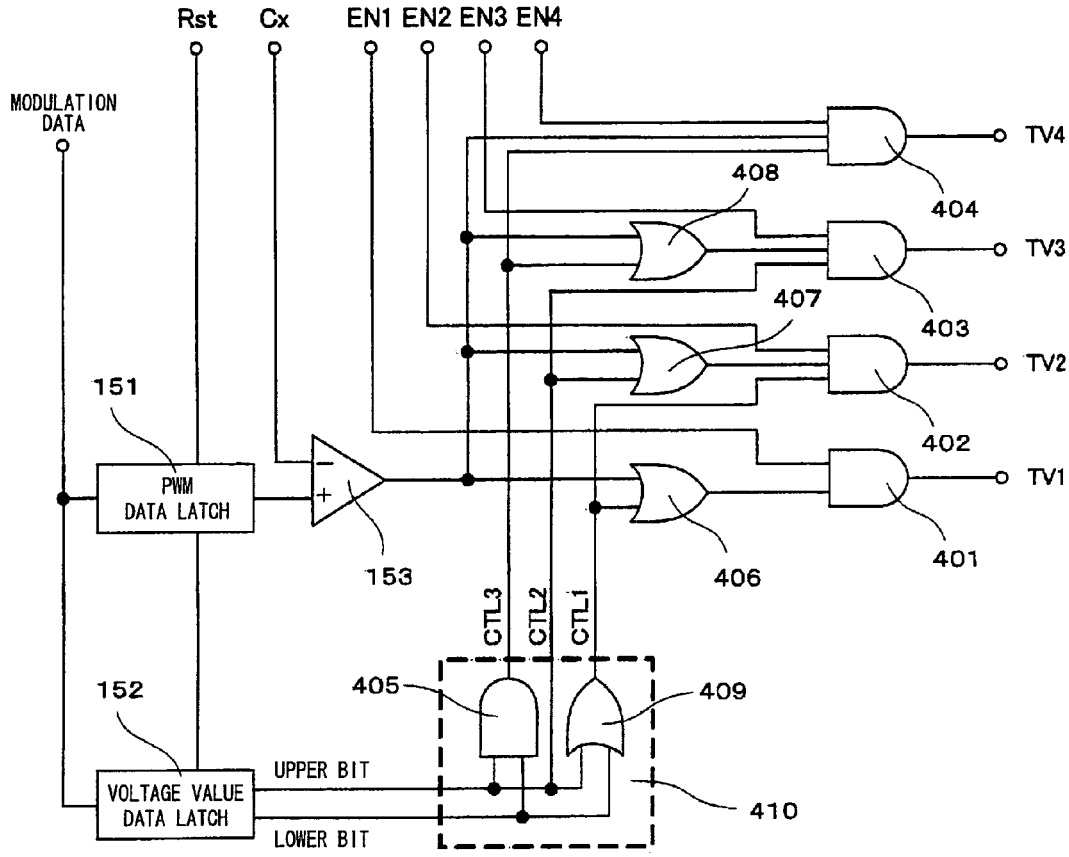
FIG. 3 is a circuit diagram illustrating an exemplary output controlling circuit in FIG. 1.

FIG. 3 illustrates an example of the output controlling circuit 101 in accordance with the present invention. The output controlling circuit 101 includes: the PWM data latch 151; the voltage value data latch 152; the comparator 153; and nine logical gates 401 to 409.

The EN1 to EN4 are respectively the output range signals of the AM-amplitudes, and are generated in the output-range signal generating circuit 120. Further, the Cx is the numerical data whose numerical value is counted up, and which is generated in the counter 130. The modulation data 161 is 11 bit data including 2 bits of the maximum amplitude value data, and 9 bits of output-ending position data. Of the modulation data 161, the upper 2 bits (i.e. maximum amplitude value data) are read into the voltage value data latch 152 in sync with the sync signal Rst, and the lower 9 bits (i.e. output-ending position data) are read into the PWM data latch 151 in sync with the sync signal Rst.

The comparator 153 compares, with the counter data Cx, the output-ending position data stored in the PWM data latch 151. Then, the comparator 153 outputs "1", if the counter data Cx is not more than the output-ending position data, and outputs "0" if the Cx is more than the output-ending position data. Accordingly, the comparator 153 continuously outputs "1," as its output signal, until the counter data Cx surpasses the output-ending position data. When the counter data Cx surpasses the output-ending position data, the output signal of the comparator 153 transits to "0". This output signal of "0" serves as an output-end timing signal of the maximum amplitude.

The maximum amplitude value data stored in the voltage value data latch 152 is 2 bit data, and each value of this 2 bit data (i.e. "00", "01", "10", or "11") designates one step out of the 4 steps of voltage. More specifically, the value of "00" designates V1 as the maximum amplitude of the drive signal 162 to be outputted, "01" designates V2, "10" designates V3, and "11" designates V4. The data stored in the voltage value data latch 152 is decoded in a decoder section 410 having an AND gate 405 and an OR gate 409, and then is outputted as three control signals CTL 1 to CTL 3 from the decoder section 410.

FIG. 7 illustrates a truth table of the data stored in the voltage value data latch 152 and the control signals CTL1 to CTL3. The control signals CTL1 to CTL3 are respectively supplied to the AND gates 402 to 404, and the OR gates 406 to 408, for the purpose of controlling each of the gates.

In each of the OR gates 406 to 408, if one of input terminals (first terminal) is "1", the output is fixed at "1" regardless of the status of the remaining terminal (second terminal). On the other hand, if the first terminal is "0", the output varies according to an input to the second terminal. Supposing that the first terminal is a controlling terminal, each of the OR gates 406 to 408 are regarded as a gate circuit which enters the OFF state while the input to the control terminal is "1,", and which enters the ON state while the input to the controlling terminal is "0". Similarly, in each of the AND gates 402 to 404, if one of input terminals (first terminal) is "0", the output is fixed at "0" regardless of the status of the remaining terminal (second terminal). On the other hand, if the first terminal is "1", the output varies according to an input to the second terminal. Supposing that the first terminal is a controlling terminal, each of the AND gates 402 to 404 are regarded as a gate circuit which enters the OFF state while the input to the control terminal is "0", and which enters the ON state while the input to the controlling terminal is "1".

The control signal CTL1 is input to the OR gate 406 and the AND gate 402. While the control signal CTL1 is "0", the OR gate 406 is in the ON state, and the AND gate 402 is in the OFF state. On the contrary, while the control signal CTL1 is "1,", the OR gate 406 is in the OFF state, and the AND gate 402 is in the ON state. The control signal CTL2 is input to the OR gate 407 and the AND gate 403. While the control signal CTL2 is "0", the OR gate 407 is in the ON state, and the AND gate 403 is in the OFF state. On the contrary, while the control signal CTL2 is "1", the OR gate 407 is in the OFF state, and the AND gate 403 is in the ON state. The control signal CTL3 is input to the OR gate 408 and the AND gate 404. While the control signal CTL3 is "0", the OR gate 408 is in the ON state, and the AND gate 404 is in the OFF state. On the contrary, while the control signal CTL3 is "1", the OR gate 408 is in the OFF state, and the AND gate 404 is in the ON state.

As it is apparent from the truth table in FIG. 7, the control signals CTL1 to CTL3 are all zero, when the maximum amplitude is V1. Therefore, the AND gates 402 to 404 are all in the OFF state, and only the AND gate 401 is able to transmit an input signal. At this point, the OR gate 406 is in the ON state. Therefore, the output signal of the comparator 153 is transmitted as it is to the AND gate 401. Then, a logical product of the output-range signal EN1 and the output from the OR gate 406 is outputted as the pulse width signal TV1. As a result, the pulse width signal TV1 is a signal which (A) rises to "1" at the timing where the output-range signal EN1 rises from "0" to "1", and (B) falls to "0" at the timing where the output signal of the comparator 153 transits from "1" to "0": i.e., at the timing determined by the output-ending position data of the modulation data 161. Other pulse width signals TV2 to TV3, on the other hand, remain "0".

When the maximum amplitude is V2, the control signal CTL1 transits to "1". In this case, the OR gate 406 is in the OFF state, and the output signal of the comparator 153 is not transmitted to the AND gate 401. Therefore, from the AND gate 401, the output-range signal EN1 is output, as it is, as the pulse width signal TV1. On the other hand, the AND gate 402 is in the ON state, and is able to output the pulse width signal TV2. At this point, the control signal CTL2 is still "0", and the OR gate 407 therefore is in the ON state. Thus, the output signal from the comparator 153 is transmitted as it is to the AND gate 402, and the logical product of the output-range signal EN2 and the output signal from the OR gate 407 is outputted as the pulse width signal TV2. Thus, the pulse width signal TV2 is a signal which (A) rises to "1" at the timing where the output-range signal EN2 transits from "0" to "1", and (B) falls to "0" at the timing where the output signal from the comparator 153 transits from "1" to "0": i.e., at the timing determined by the output-ending position data of the modulation data 161. The pulse width signals TV3 and TV4, on the other hand, remain "0".

When the maximum amplitude is V3, the control signal CTL2 transits to "1", unlike the case where the maximum amplitude V2. In this case, the OR gate 407 is in the OFF state, and the output signal of the comparator 153 is not transmitted to the AND gate 402. Therefore, from the AND gate 402, the output-range signal EN2 is outputted, as it is, as the pulse width signal TV2. Meanwhile, the AND gate 403 is in the ON state, and is able to output the pulse width signal TV3. At this point, the control signal CTL3 is "0", and the OR gate 408 therefore is in the ON state. Accordingly, the output signal from the comparator 153 is transmitted as it is to the AND gate 403, and a logical product of the output-range signal EN3 and the output signal from the OR gate 408 is output as the pulse width signal TV3. Thus, the pulse width signal TV3 is a signal which (A) transits to "1" at the timing where the output range signal EN3 rises from "0" to "1", and (B) falls to "0" at the timing where the output signal of the comparator 153 transits from "1" to "0": i.e., at the timing determined by the output-ending position data of the modulation data 161. The pulse width signal TV4, on the other hand, remains "0".

When the maximum amplitude is V4, the control signal CTL3 is "1", unlike the case where the maximum amplitude is V3. In this case, the OR gate 408 is in the OFF state, and the output signal of the comparator 153 is not transmitted to the AND gate 403. Therefore, from the AND gate 403, the output-range signal EN3 is outputted, as it is, as the pulse width signal TV3. Meanwhile, the AND gate 404 is in the ON state, and therefore is able to output the pulse width signal TV4. Since the output signal of the comparator 153 is supplied to the AND gate 404, a logical product of the output-range signal EN4 and the output signal of the comparator 153 is outputted as the pulse width signal TV4. Thus, the pulse width signal TV4 is a signal which (A) rises to "1" at the timing where the output-range signal EN4 rises from "0" to "1", and (B) falls to "0" at the timing where the output signal of the comparator 153 transits from "1" to "0": i.e., at the timing determined by the output-ending position data of the modulation data 161.

As described, the output controlling circuit 101 operates as follows. Namely, for the maximum amplitude, of a drive waveform, which is designated by the maximum amplitude value data in the modulation data 161, the controlling circuit 101 generates a signal of a pulse width regulated by the output-ending position data in the modulation data 161. Further, the output control circuit 101 outputs, as it is, the output-range signal as the pulse width signal for an amplitude which is smaller than the maximum amplitude.

Figure 8:
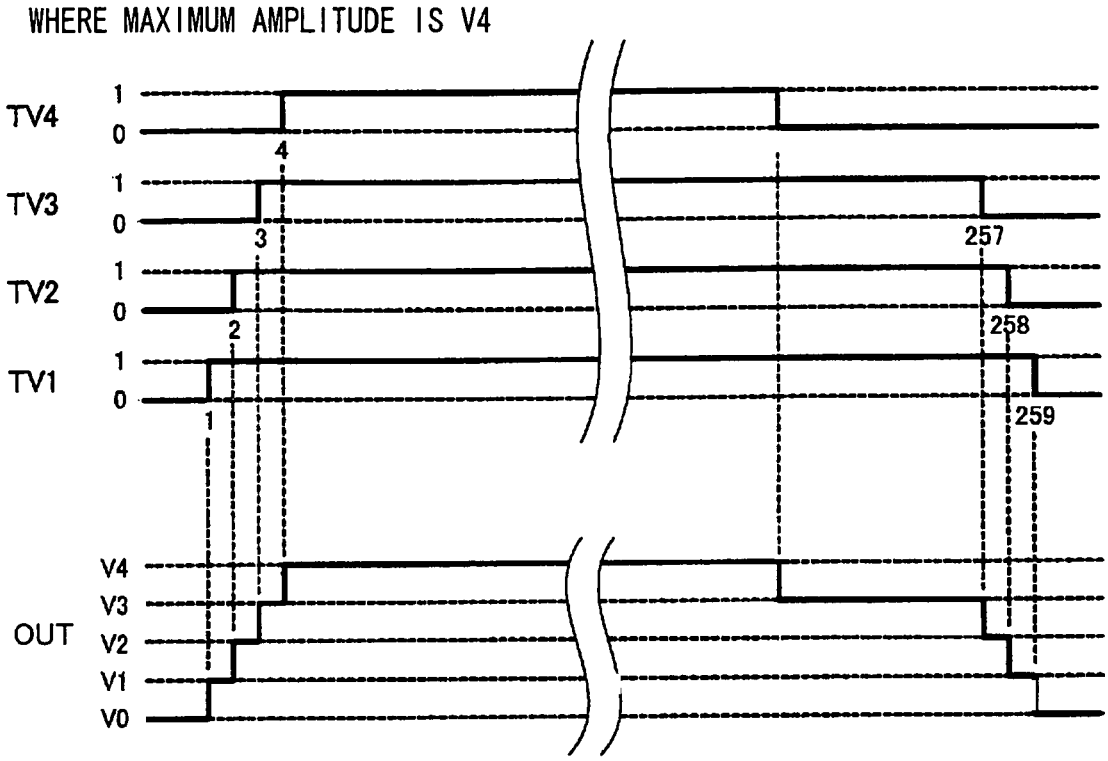
FIG. 8 is an output signal waveform chart for explaining respective operations of the circuits illustrated in FIG. 3 and FIG. 4.

FIG. 8 illustrates exemplary waveforms of the pulse width signals TV1 to TV4 outputted from the output controlling circuit 101, and the drive waveform OUT formed based on the pulse width signals TV1 to TV4. The pulse width signals TV1 to TV4 rise at the timing determined by the rising timing of the output-range signals EN1 to EN4 of FIG. 6, respectively. Similarly, the pulse width signals TV1 to TV3 fall at the falling timing of the output-range signals EN1 to EN3, respectively. Only the pulse width signal TV4 for the maximum amplitude V4 falls at the timing determined by the output-ending position data in the modulation data 161.

The pulse width signals TV1 to TV4 are input to the output circuits 111 to 11X, and are ultimately shaped into a drive waveform OUT for driving the luminescent elements. In accordance with the timings of the pulse width signals, the output circuits 111 to 11X output respective electric potentials of the AM amplitudes, so as to generate a drive waveform which has been subjected to the AM control and the PWM control.

Figure 4:
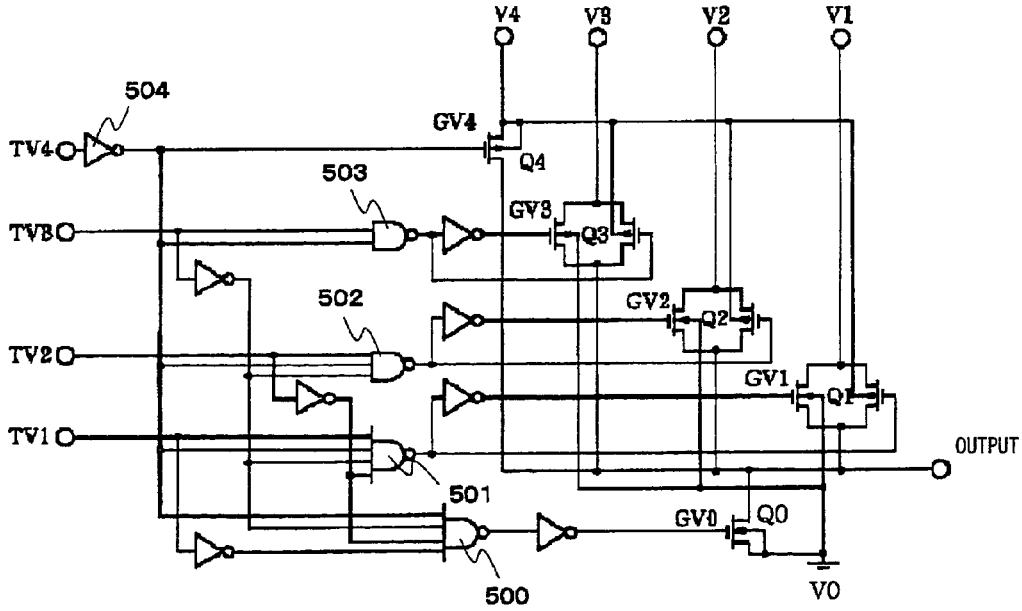
FIG. 4 is a circuit diagram illustrating a concrete example of output circuit of FIG. 1.

FIG. 4 illustrates examples of conventionally known output circuits 111 to 11X. V1 to V4 are electric potentials supplied from the power source circuit 140 which is externally arranged, and correspond to each of the four stepped AM-amplitudes of the drive signal 162. The electric potentials V1 to V4 are coupled with the output terminal OUTPUT via a transistor and paired-transistors (Q1 to Q4) respectively. While the transistor or paired-transistors (Q1 to Q4) is/are in the ON state, the associated electric potential(s) is/are supplied to the output terminal OUTPUT. Further, the output terminal OUTPUT is also connected to a reference potential V0 via a transistor Q0. The reference potential V0 is outputted to the output terminal OUTPUT, while the transistor Q0 is in the ON state. The transistors Q0 to Q4 are respectively controlled by gate signals GV0 to GV4 which are respectively generated from the pulse width signals TV1 to TV4, in a logical circuit including eight NOT gates and four NAND gates 500 to 503.

From the pulse width signal TV1 to TV4, the logical circuit selects a pulse width signal whose value is "1", and whose amplitude is the largest. Then, the logical circuit generates a gate signal so that only the associated transistor enters in the ON state. The following describes this operation.

The pulse width signal TV4 is input to the NOT gate 504, and is inverted, so that the pulse width signal TV4 becomes the gate signal GV4. The pulse width signal TV3 is input to one of input terminals of the NAND gate 503 which outputs the gate signal GV3. To the other input terminal of the NAND gate 503, an inverted signal of the pulse width signal TV4 is input. Further, the pulse width signal TV2 is input to one of the input terminals of the NAND gate 502 which outputs the control gate signal GV2. Further, to the other two input terminals of the NAND gate 502, inverted signals of the pulse width signals TV4 and TV3 are respectively input. Further, the pulse width signal TV1 is input to one of input terminals of the NAND gate 501 which outputs the gate signal GV1. To the other three input terminals, the inverted signals of the pulse width signals TV4, TV3, and TV2 are respectively input. Further, the inverted signals of the pulse width signals TV4 to TV1 are respectively input to four input terminals of the NAND gate 500 which outputs the gate signal GV0.

Since the gate signal GV4 is the inversion of the pulse width signal TV4, the gate signal GV4 is "0" if the pulse width signal TV4 is "1". Thus, the transistor Q4 is in the ON state. At this point, the inverted signal "0" of the pulse width signal TV4 is also input to the respective input terminals of the four NAND gates 500 to 503. Accordingly, the NAND gates 500 to 503 are in the OFF state, and "1" is outputted from the NAND gates 500 to 503 irrespective of the pulse width signals TV1 to TV3. Since the gate signals GV0 to GV3 are the inverted signals of the outputted from the NAND gates 500 to 503, the value of the gate signals GV0 to GV3 are "0". Thus, the transistors Q0 to Q3 are in the OFF state. In this case, if the pulse width signal TV4 is "1", only the transistor Q4 is in the ON state. Thus, the electric potential V4 is supplied to the output terminal OUTPUT.

If the pulse width signal TV4 is "0", the transistor Q4 is in the OFF state. At this point, if the pulse width signal TV3 is "1", the gate signal GV3 is "1", and the Q3 therefore is in the ON state. On the other hand, the inverted signal "0" of the pulse width signal TV3 is input to the input terminals of the NAND gates 500 to 502. Accordingly, these NAND gates are in the OFF state, and the gate signals GV0 to GV2 are "0" irrespective of the pulse width signals TV1 to TV2. As a result, the transistors Q0 to Q3 are in the OFF state. In this case, only the transistor Q3 is in the ON state if the pulse width signal TV4 is "0", and if the pulse width signal TV3 is "1". Thus, the electric potential V3 is supplied to the output terminal OUTPUT.

Through the similar operation, if the pulse width signals TV3 and TV4 is "0", and the TV2 is "1", the power source electric potential V2 is supplied to the output terminal OUTPUT. Further, If the pulse width signals TV2 to TV4 are "0", and if the TV1 is "1", the power source electric potential V1 is supplied to the output terminal OUTPUT. Further, only the gate signal GV0 is "1", if all of the pulse width signals TV1 to TV4 are "0". As such, the reference electric potential V0 is supplied.

As described, in the output circuits 111 to 11X, there is outputted, to the output terminal OUTPUT, an electric potential of the largest amplitude of the input signals (i.e., pulse width signals TV1 to TV4 respectively corresponding to four levels of amplitudes), however amongst which take the value of "1". Based on the pulse width signals respectively corresponding to the AM amplitudes, there is generated the drive signal 162 whose drive waveform OUT has been subjected to the four-step AM control the PWM control, as illustrated in FIG. 8.

With the above described configuration, it is possible to efficiently generate a drive waveform having stair-like rising and falling shapes, the drive waveform having been subject to the AM control and the PWM control. The signal of the output-range signal generating circuit 120 is commonly applied to the output controlling circuits 101 to 10X, the number of which circuits corresponding to the number of simultaneously driven pixels in the same row. Accordingly, the drive circuit only requires one or several output-range signal generating circuit(s) 120, and each output only requires: (A) the output controlling circuits 101 to 10X each including one 11 bit PWM data latch, one 2 bit voltage value data latch, one comparator, and nine AND gates or OR gates; and (B) the output circuits 111 to 11X each having a simple configuration which includes a gate circuit and a transistor. Thus, it is possible to keep the circuit scale extremely small, which consequently allows the reduction of a layout area in an integration circuit. This is advantageous in terms of cost. Furthermore, a data amount required for each output is: 9 bits+2 bits=11 bits. Therefore, a high-speed communication is not necessary, and it is possible to easily ensure the quality of the data.

Note that the present invention is not limited to the circuit exemplified in the present embodiment, and it is apparent that the function of the circuit including the AND gates or OR gates is also realized by using a circuit including NAND gates or NOR gates.

Further, the present embodiment deals with the example where a drive waveform obtained by performing a combination of the 4-grayscale AM and the 259-PWM is used for controlling 1024 grayscales per pixel. However, the present invention is not limited to this, and the same effects are obtained irrespective of the number of the grayscale levels. Further, the rising and falling shapes in a voltage amplitude are not limited to the stair-like shape of the present embodiment, and various shapes may be possible by, for example, varying the value of the output-range data memory 125.

Embodiment 2

Figure 9:
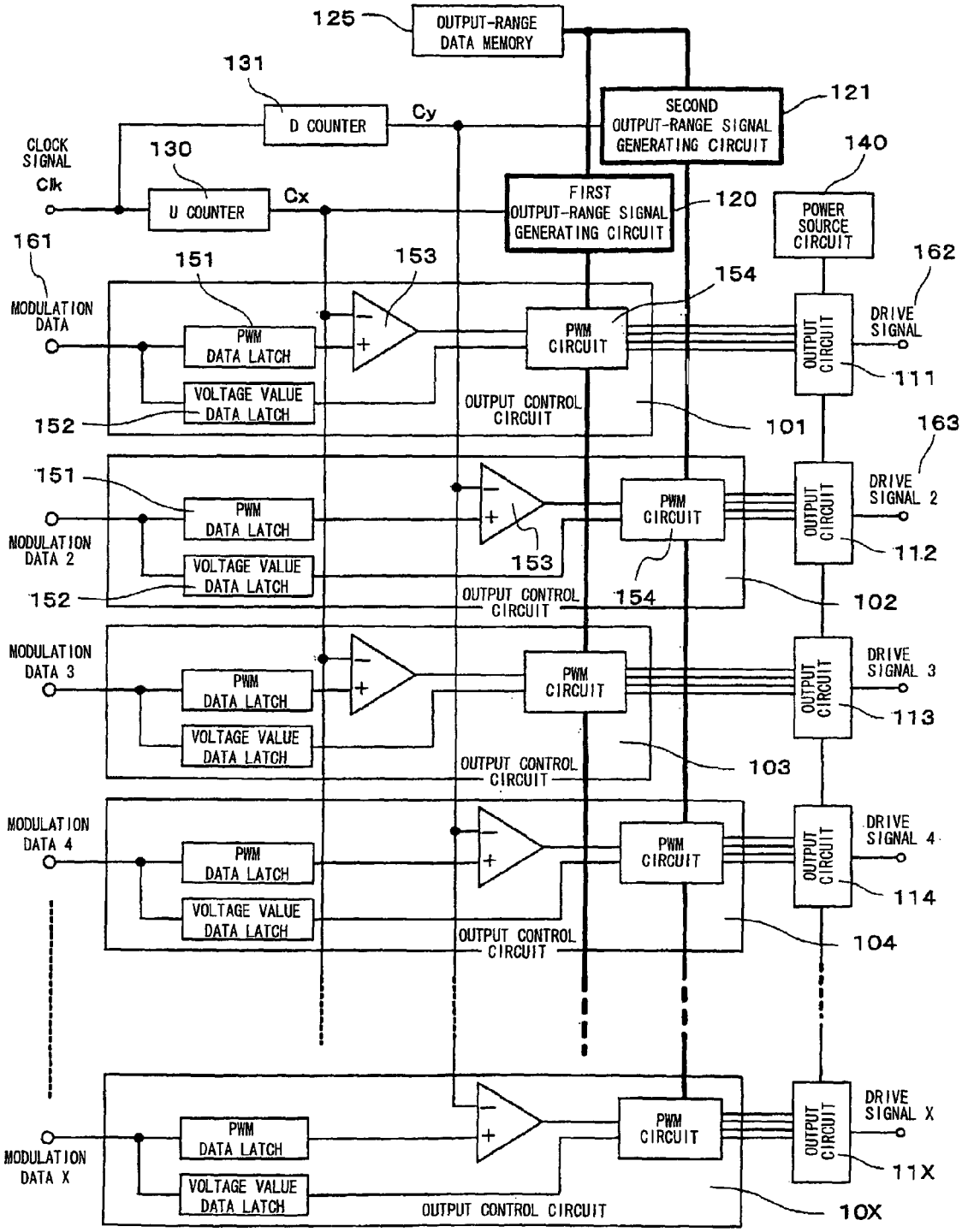
FIG. 9 is a block diagram illustrating a configuration of Embodiment 2 in accordance with the present invention.

FIG. 9 is a circuit block diagram illustrating a drive circuit of Embodiment 2 in accordance with the present invention. The same numbers are given to members whose configurations or functions are the same as those of the foregoing Embodiment 1, and the detailed explanations are omitted here. For the sake of simplicity, the figure does not indicate the sync signal Rst. However, the sync signal Rst is supplied to a circuit which requires it, as in the circuit of FIG. 1.

The drive circuit includes: an output-range data memory 125; a first output-range signal generating circuit (output-range signal generating means) 120; a second output-range signal generating circuit (output-range signal generating means) 121; an U counter 130 which performs a counting up process; a D counter 131 which performs a counting down process; output controlling circuits 101 to 10X and output circuits 111 to 11X for simultaneously driving a plurality of luminescent elements aligned in a row selected according to a scan signal; and a power sauces circuit 140 for supplying, to the output circuit 111 to 11X, electric potentials respectively corresponding to AM amplitudes which are obtained as a result of performing the AM Process.

The output controlling circuits 101 to 10X and the output circuits 111 to 11X respectively have the same configurations as those of the drive circuit described in the foregoing Embodiment 1, with reference to FIG. 1. The drive circuits of Embodiment 1 and Embodiment 2 are different from each other in that the drive circuit of Embodiment 2 includes (i) two counters 130 and 131 which respectively perform the counting up and the counting down process, and (ii) the second output-range signal generating circuit 121. Note that the configurations of the first and second output-range signal generating circuits 120 and 121 are identical to each other, and are the same as those described in Embodiment 1. Further, the output-range data memory 125 commonly supplies data to both of the output-range signal generating circuits 120 and 121.

The U counter 130 which performs the counting up process supplies data Cx to (A) the first output-range signal generating circuit 120, and (B) each comparator 153 in every other output controlling circuits 101 to 10X: i.e. to the comparator 153 in the odd-numbered output controlling circuits. The D counter 131 which performs the counting down process supplies data Cy to (A) the second output-range signal generating circuit 121, and (B) each comparator 153 in every other output controlling circuits 101 to 10X: i.e. to the comparator 153 in the even-numbered output controlling circuits. The output signal of the first output-range signal generating circuit 120 is supplied to a PWM circuit 154 in every other output controlling circuits 101 to 10X: i.e., to each PWM circuit 154 in the odd-numbered output controlling circuits. The output signal of the second output-range signal generating circuit 121 is supplied to a PWM circuit 154 in every other output controlling circuits 101 to 10X: i.e., to each PWM circuit 154 in the even-numbered output controlling circuits.

Figure 10:
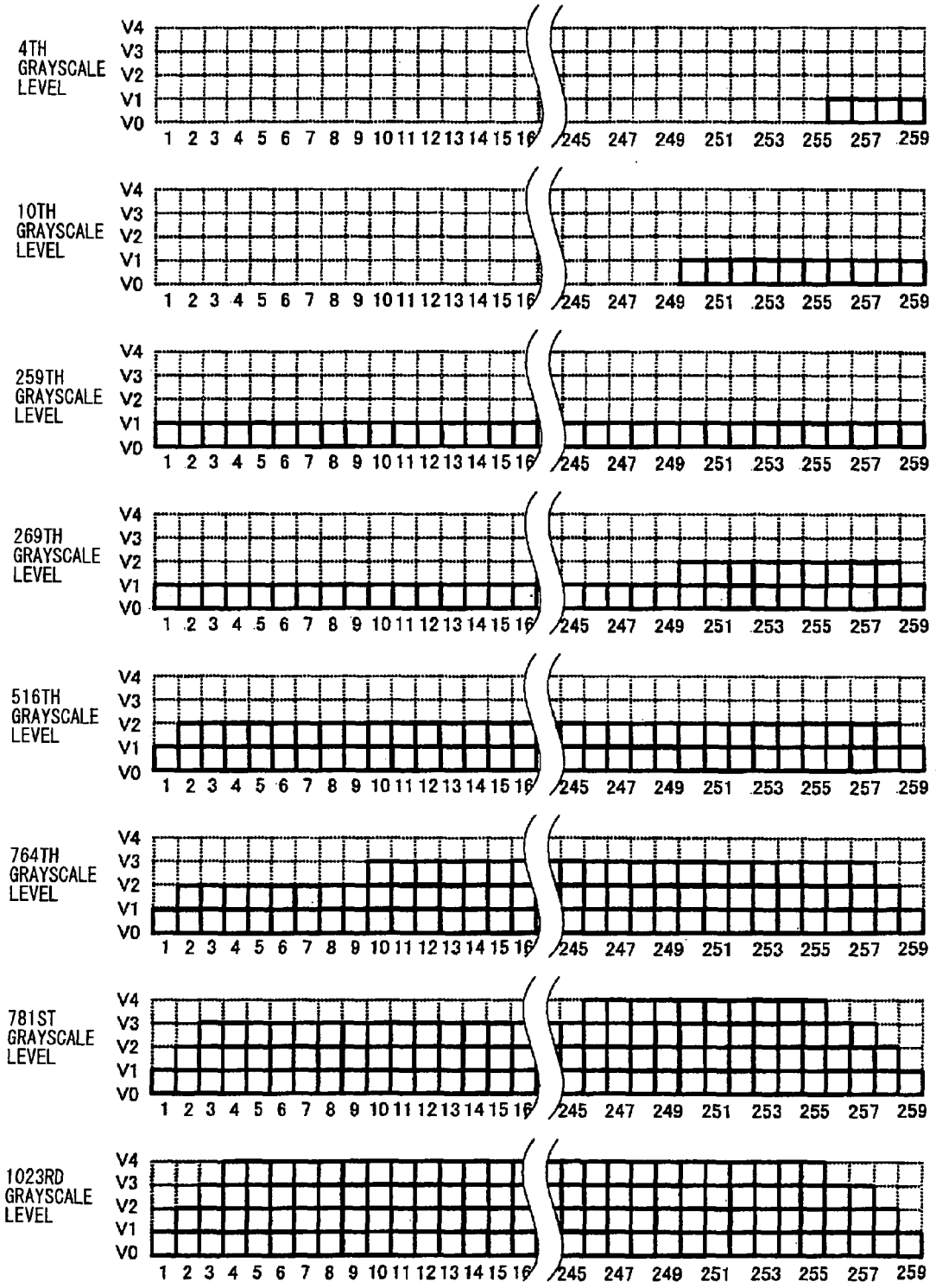
FIG. 10 is a drive waveform chart for explaining an operation of the circuit illustrated in FIG. 9.
Figure 11:
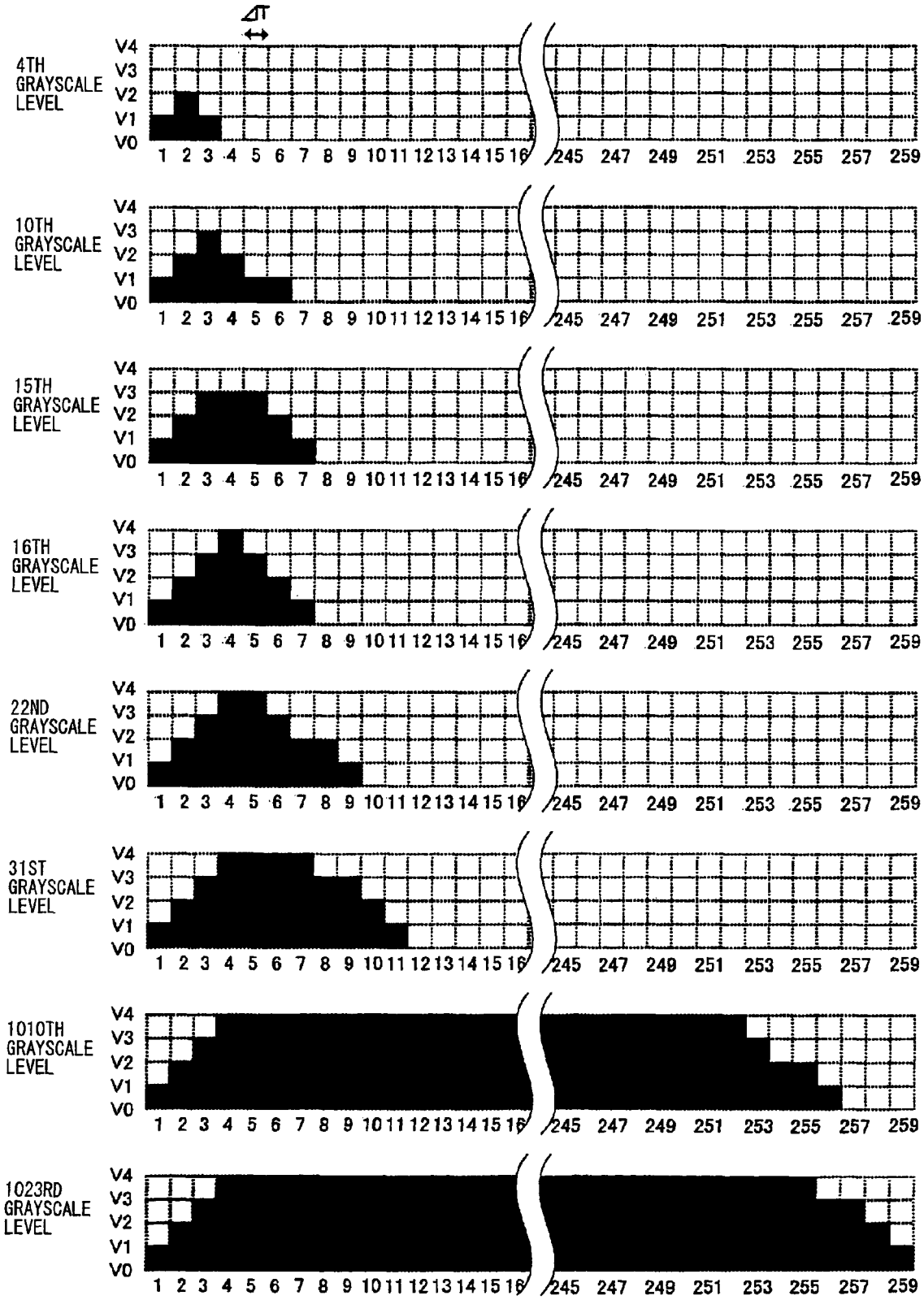
FIG. 11 is a drive waveform chart for explaining "BACKGROUND ART".
Figure 12:
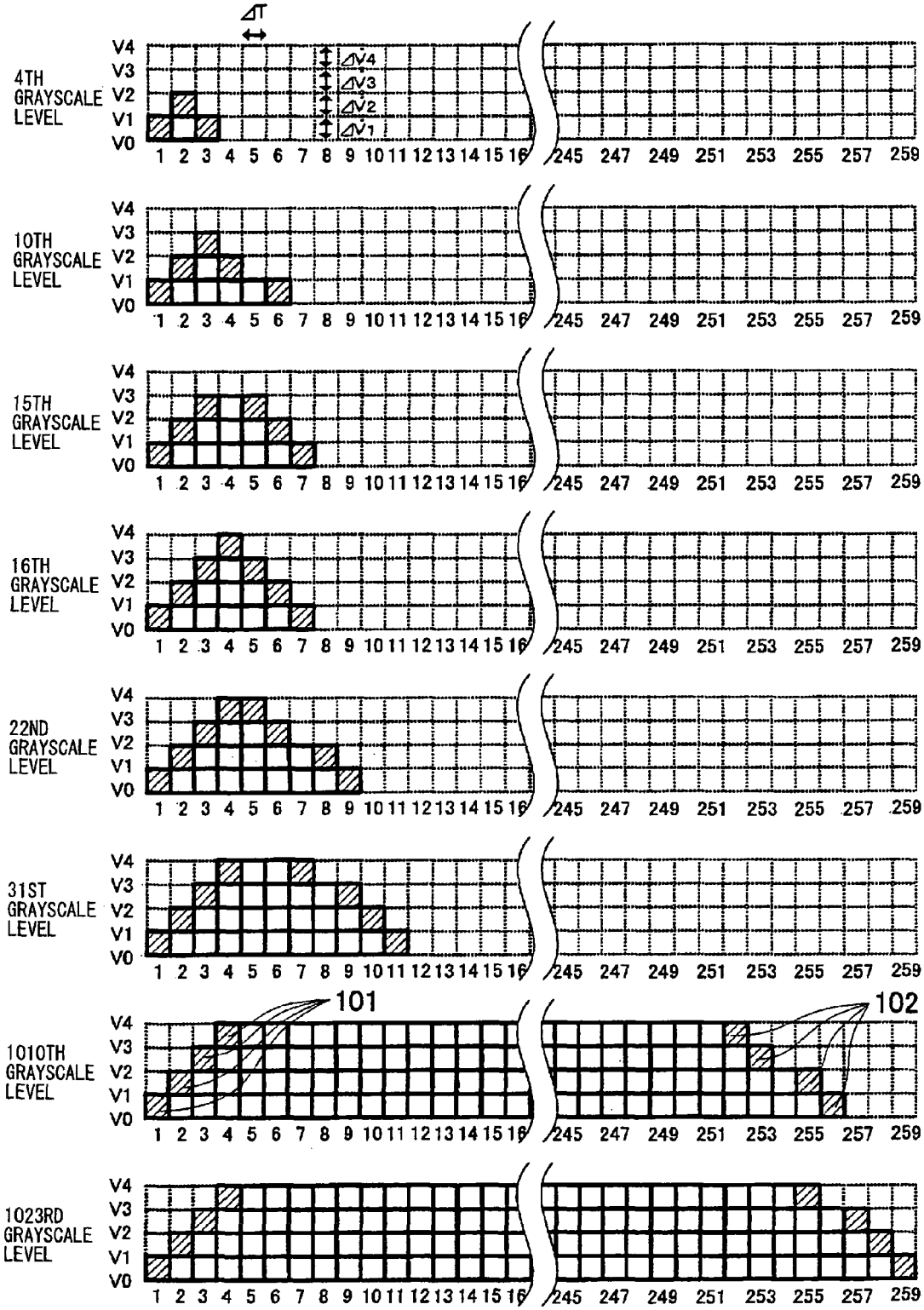
FIG. 12 is an explanatory drive waveform chart for defining the waveform illustrated in FIG. 11.

In this configuration, a drive signal 162 outputted from each odd-numbered output controlling circuit and odd-numbered output circuit is the same as Embodiment 1. In other words, there is outputted a drive waveform having such a shape that a drive waveform block is sequentially aligned from the smaller side on the time axis, with an increase in the grayscale level (See FIG. 13). On the other hand, a drive signal 163 outputted from each even-numbered output controlling circuit and even-numbered output circuit is formed based on an output-range signal and an output-end timing signal of the maximum amplitude. The output-range signal is generated, in the second output-range signal generating circuit 121, based on the Cy data of the D counter 131. The output-end timing signal is generated by comparing, in the comparator 153, the data Cy of the D counter 131 with output-ending position data of the maximum amplitude. As a result, a drive waveform outputted from each even-numbered circuit has such a shape that a drive waveform block is sequentially aligned from the larger side of the time axis, with an increase in the grayscale level (See FIG. 10).

The drive signals are outputted to the simultaneously driven luminescent elements in the same row so that the drive signals alternately have: (A) the signal which rises from the smaller side of the time axis; and (B) the signal which rises from the larger side of the time axis. This averages the overall drive potential, in terms of time axis. The use of such a drive waveforms is advantageous in supplying highly-accurate drive waveforms, on the grounds that (A) variation in the drive current is reduced, and (B) the load for the power source circuit 140 supplying electric potentials of the drive signals is stabilized.

By adopting the present invention, it is possible to realize a drive circuit which generates the above described preferable drive waveform, with the use of a few additional circuits.

As described, a drive circuit of the present invention is a drive circuit for outputting a drive waveform so as to drive a display element in accordance with grayscale information, the drive waveform being controlled by (i) a plural-stepped voltage amplitude modulation and (ii) a pulse width modulation which is settable for each voltage amplitude of the plural-stepped voltage amplitude modulation, said drive circuit comprising output control means for controlling the drive waveform, at a time of modulating arbitrary grayscale information, said output control means (A) latching a signal indicating a pulse width corresponding to a maximum voltage amplitude to be outputted so as to control a pulse width of the maximum voltage amplitude, and (B) outputting a maximum pulse width for a voltage amplitude smaller than the maximum voltage amplitude.

In this drive circuit, the drive waveform is generated based on modulation data which includes a maximum value of a voltage amplitude to be outputted, and an output-ending position of the maximum voltage amplitude. For the maximum voltage amplitude, the pulse width is controlled based on the modulation data, and the maximum pulse width is outputted for an amplitude other than the maximum voltage amplitude. Thus, a drive waveform indicating a predetermined grayscale level is formed, and a luminescent element is driven by the drive waveform.

Further, a drive circuit of the present invention is a drive circuit for outputting a drive waveform so as to drive a display element in accordance with grayscale information, the drive waveform being controlled by (i) a plural-stepped voltage amplitude modulation and (ii) a pulse width modulation which is settable for each voltage amplitude of the plural-stepped voltage amplitude modulation, said drive circuit comprising: voltage value data latching means, at a time of modulating arbitrary grayscale information, for latching first data indicating a maximum voltage amplitude to be outputted; PWM data latching means, at the time of modulating arbitrary grayscale information, for latching second data indicating a pulse width of the maximum voltage amplitude; output-range signal generating means, at the time of modulating arbitrary grayscale information, for generating and outputting an output-range signal in accordance with a maximum pulse width of each voltage amplitude; and one or more control means, at the time of modulating arbitrary grayscale information, for (a) outputting a pulse width of the maximum voltage amplitude according to the first data and the second data, and (b) outputting a maximum pulse width according to the output-range signal, when a voltage amplitude is smaller than the maximum voltage amplitude.

In this drive circuit, a voltage value data latching section (voltage value data latching means) latches maximum voltage amplitude data (first data) from the grayscale information, and the PWM data latching section (PWM data latching means) latches pulse width data (second data) of the maximum voltage amplitude. Further, with the use of output-range signal generating section (output-range signal generating means), a voltage amplitude other than the maximum voltage amplitude is outputted with a maximum pulse width. Further, control section (control means) outputs (i) a pulse width of the maximum voltage amplitude, in accordance with the maximum amplitude data and the pulse width data for the maximum voltage amplitude, and (ii) a maximum pulse width for each voltage amplitude smaller than the maximum voltage amplitude. Thus, a drive waveform indicating a predetermined grayscale level is formed, and a luminescent element is driven by the drive waveform.

In each of these drive circuits, an intended drive waveform is generated simply by generating, from the modulation data, a pulse width signal for the maximum amplitude. Thus, it is possible to reduce the circuit scale.

Further, the output-range signal generating section generates the output-range signal. The output-range signal is commonly supplied to the plurality of the output controlling circuits which generate drive signals for the plurality of pixels on the same scanning line. Thus, the drive circuit only needs one or several output-range signal generating sections(s), and reduction of the circuit scale is possible.

Further, there is provided an output-range data memory which stores therein an output-starting position and the output-ending position which correspond to the maximum pulse width of each of the plural steps of the voltage amplitudes. The output-range signal generating section compares, with a value of a counter, the output-starting position data and the output-ending position data stored in the output-range data memory, so as to generate the output-range signal. The output-starting position data and the output-ending position data corresponding to the maximum pulse width are constant, and it is only necessary to provide these pieces of data for each of the plural steps of the voltage amplitudes. Accordingly, a necessary memory scale is small, and the drive circuit needs only one or several memories, as is the case of the output-range signal generating section.

As described, with the drive circuit of the present invention, a maximum pulse width is outputted for an amplitude other than the maximum amplitude, the control section for the drive waveform only needs to generate a pulse width for the maximum amplitude. Accordingly, the drive circuit is configured by a simple circuits, and the circuit scale is made small.

Furthermore, since each output only requires modulation data for supplying the pulse width of the maximum amplitude, the data amount of the modulation data is small. Therefore, a high-speed communication is not necessary, and it is possible to easily ensure the quality of the data.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A drive circuit for outputting a drive waveform so as to drive a display element in accordance with grayscale information, the drive waveform being controlled by (i) a plural-stepped voltage amplitude modulation including only one single voltage value data latching section that latches maximum amplitude data from the grayscale information and only one single PWM data latching section that latches pulse width data of the maximum voltage amplitude and (ii) a pulse width modulation which is settable for each voltage amplitude of the plural-stepped voltage amplitude modulation, wherein among the plural-stepped voltage amplitudes, a smaller voltage amplitude is wider in maximum pulse width;

said drive circuit comprising an output control circuit that controls the drive waveform, at a time of modulating arbitrary grayscale information, said output control circuit (A) latching a signal indicating a pulse width corresponding to a maximum voltage amplitude to be outputted so as to control a pulse width of the maximum voltage amplitude, and (B) outputting a maximum pulse width for a voltage amplitude smaller than the maximum voltage amplitude.

2. A drive circuit for outputting a drive waveform so as to drive a display element in accordance with grayscale information, the drive waveform being controlled by (i) a plural-stepped voltage amplitude modulation including only one single voltage value data latching section that latches maximum amplitude data from the grayscale information and only one single PWM data latching section that latches pulse width data of the maximum voltage amplitude and (ii) a pulse width modulation which is settable for each voltage amplitude of the plural-stepped voltage amplitude modulation;

wherein among the plural-stepped voltage amplitudes, a smaller voltage amplitude is wider in maximum pulse width;

wherein said only one single voltage value data latching section, at a time of modulating arbitrary grayscale information, latches first data indicating a maximum voltage amplitude to be outputted;

wherein said only one single PWM data latching section, at the time of modulating arbitrary grayscale information, latches second data indicating a pulse width of the maximum voltage amplitude;

wherein said drive circuit further comprises:

an output-range signal generating section that, at the time of modulating arbitrary grayscale information, generates and outputs an output-range signal in accordance with a maximum pulse width of each voltage amplitude; and one or more control sections that output, at the time of modulating arbitrary grayscale information, (a) a pulse width of the maximum voltage amplitude according to the first data and the second data, and (b) a maximum pulse width according to the output-range signal, when a voltage amplitude is smaller than the maximum voltage amplitude.

3. The drive circuit as set forth in claim 2, wherein:

(A) the drive waveform is a drive waveform (i) which has been subjected to the voltage amplitude modulation in which n-step electric potentials sequentially increase from V1 to Vn (where n is an integer of not less than 1) in accordance with the number of grayscale units indicated by the grayscale information and (ii) which has been subjected to the pulse width modulation in which, for each of the n-step voltage amplitudes, m-step pulse widths fall within a range of a unit pulse width $\Delta T$ to a maximum pulse width $\Delta T \times m$ (where m is an integer of not less than 1) in accordance with the number of grayscale units indicated by the grayscale information;

(B) when expressing an outline shape of the drive waveform by placing in a matrix grayscale blocks, having a size of $(\Delta Vk \times \Delta T)$, whose number corresponds to that of the grayscale units, the matrix being formed in a plane defined by an axis of coordinate including (i) a voltage axis extending longitudinally on which axis a voltage increases as the voltage is located upward and (ii) a time axis extending transversely on which a time increases as the time is located rightward, the matrix including n rows of first row to n-th row for each $\Delta Vk = Vk - V(k-1)$ (where k is an integer and is $1 \leqq k \leqq n$, V0 is a reference electric potential corresponding to zero brightness, and $\Delta Vk$ indicates one grayscale unit expressed as a voltage amplitude) and m columns of first column to m-th column for each $\Delta T$ indicating one grayscale unit expressed as a pulse width;

(C) the shape of the drive waveform is formed by sequentially placing the grayscale blocks from a lowermost row, according to rules such that: (i) the grayscale blocks are placed, with no space between the grayscale blocks, in a placeable range which is determined for each row, and (ii) when the placeable range of a lower row is filled with the grayscale blocks, the grayscale blocks are placed in a row above said lower row, and (D) said only one single voltage value data latching section latches the first data indicating a row in which a final grayscale block is placed, in the drive waveform corresponding to the arbitrary grayscale information; and (E) said only one single PWM data latching section latches the second data indicating a column in which the final grayscale block is placed.

4. The drive circuit as set forth in claim 2, wherein said output-range signal generating section commonly supplies the output-range signal to a plurality of said control sections which respectively generate drive waveforms to be supplied to a plurality of pixels on a scanning line of a display element.

5. The drive circuit as set forth in claim 4, wherein the output-range signal is generated based on: (A) output-starting position data and output-ending position data, stored in an output-range data memory; and (B) a digital signal of at least two bits causing counting up or counting down.

6. The drive circuit as set forth in claim 4, wherein said output-range signal generating section simultaneously generates, as the output-range signal:

(A) a first output-range signal generated based on (i) output-starting position data and output-ending position data, stored in an output-range data memory, and (ii) a digital signal of at least two bits causing counting up; and (B) a second output-range signal based on (i) the output-starting position data and the output-ending position data, and (ii) a digital signal of at least two bits causing counting down.

7. The drive circuit as set forth in claim 2, wherein:

the pulse width modulation generates, for each voltage amplitude, a pulse width signal that is modulated to a pulse width to be outputted; wherein said pulse width signal is generated from (i) the output of the output-range signal generating section, (ii) the first data indicating a maximum voltage amplitude to be outputted, and (iii) the second data indicating a pulse width of the maximum voltage amplitude.

8. The drive circuit as set forth in claim 2, wherein the drive element includes a plurality of pixels, wherein the drive circuit is arranged to drive each of the plurality of pixels in accordance with grayscale information for each pixel, and wherein there is only one single voltage value data latching section and only one single PWM data latching section for each of the plurality of pixels.

9. The drive circuit as set forth in claim 8, wherein the plurality of pixels are arranged in rows, where there is at least one pixel in each row, and wherein there is only one single voltage value data latching section and only one single PWM data latching section for each row.

10. The drive circuit as set forth in claim 9, wherein there is a plurality of pixels in each row, and wherein there is only one single voltage value data latching section and only one single PWM data latching section to drive the plurality of pixels in each row.

11. The drive circuit as set forth in claim 10, wherein the display element further includes a plurality of scanning lines, one scanning line for each row and wherein the plurality of pixels in each row are on the scanning line for that row.

* * * * *